US008689494B2

(12) United States Patent
Leavitt

(10) Patent No.: US 8,689,494 B2
(45) Date of Patent: Apr. 8, 2014

(54) CLIMATIC PROTECTION OF FRACKING HYDRO TANKS

(75) Inventor: Andrew B. Leavitt, Columbus, OH (US)

(73) Assignee: TFL Distribution, LLC, Columbus, OH (US)

( * ) Notice: Subject to any disclaimer, the term of this patent is extended or adjusted under 35 U.S.C. 154(b) by 0 days.

(21) Appl. No.: 13/433,963

(22) Filed: Mar. 29, 2012

(65) Prior Publication Data

US 2013/0206196 A1 Aug. 15, 2013

Related U.S. Application Data

(60) Provisional application No. 61/597,458, filed on Feb. 10, 2012.

(51) Int. Cl.
*E04B 1/12* (2006.01)

(52) U.S. Cl.
USPC ..... 52/63; 52/222; 52/273; 220/668; 135/141; 135/142; 135/156; 135/161

(58) Field of Classification Search
USPC ..... 52/63, 64, 66, 222, 273, DIG. 14; 220/1.5, 668; 135/97, 141, 142, 156, 135/157, 158, 161
See application file for complete search history.

(56) References Cited

U.S. PATENT DOCUMENTS 1,450,143 A 12/1921 Dillman
2,528,721 A * 11/1950 Brockman et al. ..... 135/152
3,005,241 A 10/1961 Osmundoson
3,971,395 A 7/1976 Lipinski
4,091,584 A * 5/1978 Brown ..... 135/127
4,255,912 A 3/1981 Kovacs
4,505,126 A * 3/1985 Jones et al. ..... 62/239
4,769,962 A * 9/1988 Pohl et al. ..... 52/273
4,834,129 A * 5/1989 Pinsonneault ..... 135/90
4,878,322 A * 11/1989 Ikeda et al. ..... 52/2.18
4,926,591 A * 5/1990 Buijs ..... 52/63
5,226,264 A * 7/1993 Walters ..... 52/63
5,327,691 A * 7/1994 Eryou ..... 52/66
5,351,847 A * 10/1994 Greenbaum ..... 220/9.1
5,458,956 A * 10/1995 Shi et al. ..... 442/199
5,511,572 A * 4/1996 Carter ..... 135/145
5,660,002 A * 8/1997 Lashinger ..... 52/63
5,916,096 A * 6/1999 Wiesmann et al. ..... 52/63
6,070,371 A * 6/2000 Myrick ..... 52/63
6,257,437 B1 * 7/2001 Slater ..... 220/567.2
6,349,873 B1 * 2/2002 Slater ..... 228/184
6,363,678 B1 * 4/2002 Shuler ..... 52/656.9
6,383,242 B1 * 5/2002 Rogers et al. ..... 55/385.2
6,390,387 B1 * 5/2002 Stehling ..... 239/172
6,502,593 B1 * 1/2003 Stafford ..... 135/115
6,742,309 B2 * 6/2004 Stewart et al. ..... 52/79.5
6,944,989 B1 9/2005 Bradley (Continued)

FOREIGN PATENT DOCUMENTS

GB 2 322 154 A1 8/1998

*Primary Examiner* — Basil Katcheves
*Assistant Examiner* — Joshua Ihezie
(74) *Attorney, Agent, or Firm* — Vorys, Sater, Seymour and Pease LLP; Louis Gubinsky

(57) ABSTRACT

The present invention provides cold climatic protection to the hydro tanks and associated fluid conduits present on a frac pad. A modular endoskeleton is provided and covered by a plurality of rip resistant tarps. A heat entrapment canopy results which maintains an inner temperature above freezing even in extreme cold outside temperatures.

22 Claims, 6 Drawing Sheets

(56) References Cited

U.S. PATENT DOCUMENTS

| | | | | |
|---|---|---|---|---|
| 7,111,750 | B2 * | 9/2006 | Gulati et al. | 220/560.04 |
| 7,246,468 | B2 * | 7/2007 | Forbis et al. | 52/3 |
| 7,389,785 | B2 | 6/2008 | Loudermilk et al. | |
| 7,624,885 | B2 * | 12/2009 | Pfau | 220/1.5 |
| 7,703,467 | B2 * | 4/2010 | Stewart et al. | 135/96 |
| 7,735,502 | B1 * | 6/2010 | Hotes | 135/91 |
| 7,997,623 | B2 * | 8/2011 | Williams | 280/836 |
| 8,337,751 | B2 * | 12/2012 | Stewart et al. | 422/1 |
| 2003/0074845 | A1 * | 4/2003 | Sample et al. | 52/63 |
| 2004/0111982 | A1 * | 6/2004 | Lattanzio | 52/64 |
| 2004/0188446 | A1 * | 9/2004 | Gulati et al. | 220/651 |
| 2010/0147842 | A1 * | 6/2010 | Reynard et al. | 220/23.88 |
| 2011/0089123 | A1 | 4/2011 | Kennedy et al. | |
| 2013/0001224 | A1 * | 1/2013 | Payne | 220/4.17 |
| 2013/0004272 | A1 * | 1/2013 | Mintz | 414/304 |

* cited by examiner

CLIMATIC PROTECTION OF FRACKING HYDRO TANKS

This application claims benefit of U.S. Provisional Application 61/597458, filed Feb. 10, 2012.

BACKGROUND OF THE INVENTION

The present invention relates to the climatic protection of fracking tanks, more specifically, the protection of fracking hydro tanks and their associated fluid conduits from freezing temperatures during cold weather fracking operations.

Hydraulic fracturing is the propagation of fractures in a rock layer caused by the presence of pressurized fluid. When man-made to release petroleum products and natural gas, the procedure is called fracking or hydrofracking. The energy from the injection of highly pressurized fracking fluid creates new channels in rock which increases the extraction rate and ultimate recovery of fossil fuels. The fracture width is typically maintained after injection by introduction of proppant into the injected fluid. Proppant is a material such as grains of sand, ceramic or other particulates that prevent the fractures from closing when the injection is stopped.

Oil and natural gas recovery employing fracking technology is becoming more widespread in the United States and Canada with the increasing price of oil. Water with chemical additives is injected under pressure deep into the ground to break up rock formations to cause release of trapped oil and gas. Frac hydro tanks are used for storage of recovered water/brine held for recirculation and also as holding tanks for fresh water. During the winter months it is paramount to protect the hydro tanks, which often contain about 500,000 gallons of fluid, and associated fluid conduits (including piping, valves, pumps, etc.) from freezing since if the fluid became frozen in conduits, the fracking operation would need to be temporarily shut down, resulting in excessive expense.

G.B. 2322154A describes a tent apparatus for insulating a water tank in a roof space. The tent, which can be made of polythene, is placed over the tank, where it is attached to a rafter, and spaced from the tank, is secured at its lower points to ceiling joists. The tank can cover associated plumbing conduits and can contain means for gaining access to the water tank. GB '154 states that in an alternative embodiment, not depicted in the Drawing nor described in its specification, the tent may be supported by a frame, which could be an endoskeleton or an exoskeleton. A grill is provided in the ceiling below the tank and inside the tent to open and allow heat to rise into the tent when the air in the tent reaches below a predetermined temperature.

In contrast to G.B. '154, which involves a controlled inside environment and a relatively small capacity water tank, the present invention is directed to climatic protection from cold and wind of a plurality of large frac hydro tanks in the outdoors. Furthermore, the present invention, in contrast to the working embodiment of G.B. '154, utilizes a precisely erectable and removable endoskeletal truss system of uprights and rafters supporting rip resistant fabric tarps, and including securing means preventing its destruction from high winds. The endoskeletal truss system of the present invention can be quickly erected when needed as cold weather approaches and quickly disassembled upon advent of improved climatic conditions.

U.S. 2011/0089123A1 describes a mobile water treatment apparatus including a containment box which may be insulated and heated for protecting a fluid filtration system from freezing in extreme weather.

U.S. Pat. No. 3,971,395 describes a collapsible shelter for all season recreational use including a floor platform and front and rear plywood walls with a canvass tarp extended across beams positioned between the upright front and rear walls, the tarp defining an integral roof and side walls.

U.S. Pat. No. 3,005,241 describes a frost casing for a riser pipe attached to a water tank. Insulating sheets or panels form an insulating air space surrounding the riser.

U.S. Pat. No. 4,255,912 describes a temporary shelter of modular construction in which sheets of flexible material are used to form an insulating roof for a hallway.

U.S. Pat. No. 6,944,989 is directed to a kit for winterizing plants and trees. The kit when erected includes a skeletal upright frame wrapped in clear plastic, a canvass top and a hydro heat transfer subsystem adapted to extract heat from the ground and from heated air within the skeletal frame for transfer to the trunk of the plant or tree.

U.S. Pat. No. 7,389,785 describes a tent system including upright columns, horizontal eave members and rafters, with particular weldments uniting these structures. The tent cover can be canvass or nylon.

U.S. Pat. No. 1,450,143 describes a canvass tent structure to be positioned to either side of an automobile for forming a central garage area and side living areas. A slopping roof may be provided by angled rafters.

SUMMARY OF THE INVENTION

The system of the present invention protects fracking hydro tanks and associated conduits from below freezing temperatures, wind, snow and rain. The protection system of the present invention is modular in design, enabling it to be quickly installed and removed when not needed. The modular system of the present invention can be disassembled when climatic conditions improve, stored, and reused as cold weather again approaches.

The present invention is based on the concept of a light weight endoskeleton supporting rip resistant fabric tarps to encompass either the entire hydro tanks and associated fluid conduits or, in a preferred embodiment of the present invention, to encompass the ends, partial top sections and partial exposed sides of the hydro tanks and the associated fluid conduits.

In accordance with the present invention, there is provided, sitting on a frac pad, a cold climate-protected frac hydro tank comprising at least one frac hydro tank and associated fluid conduits extending from at least a tank end, and a modular endoskeleton overlaying at least an end section of the tank, a portion of any exposed tank side and a portion of the top of the tank, each modular unit comprising at least one first long upright or leg spaced apart from and in front of an end of the hydro tank and extending from the ground level to approximately the height of the tank, and at least a first short upright or leg positioned on top of the tank, with one or more rafters extending between the first and second uprights forming a tent-shaped endoskeleton, and rip-resistant (tear resistant) fabric tarps attached between adjacent first uprights and between adjacent rafters and between adjacent short uprights to encompass at least a portion of the top of the tank, the end of the tank and associated fluid conduits extending from the end of the tank. In one embodiment of the invention, the modular structures exist on both ends of the tank but do not extend over the entire top tank surface. In a second embodiment of the invention, the modular structures exist on both ends of the tank and extend over the entire top tank surface. In another embodiment of the invention, the tarps between the first uprights do not extend to ground level. In a further embodiment of the invention the tarps are secured to the tanks and to the uprights and rafters using heavy duty ties, such as cargo straps or bungee like elasticized cords, the uprights and rafters containing apertures through which the ties are attached. The heavy duty ties can be made of various natural and man-made materials, such as cotton, nylon, polypropylene and polyethylene.

In another embodiment of the invention, in order to enclose a side portion of a hydro tank, a module of the endoskeleton additionally includes a second long leg spaced apart from the side of an end unit hydro tank in line with (substantially across from) the first short leg and extending vertically from the ground to a height of about the top of the first short leg, and a third long leg positioned directly across from and at substantially the same distance from a tank end as the first long leg, and to the side in line with the second long leg, and extending vertically from the ground to about the same height as the first long leg, with a rafter extending between the tops of the second and third long legs.

In a more preferred embodiment of the invention, one or more legs of a module are height adjustable.

In another preferred embodiment of the invention, the rafters are formed of a plurality of rafter segments.

In still another preferred embodiment of the invention, cross beams connect adjacent pairs of rafters.

In yet another preferred embodiment of the invention, at least one short and/or long leg is constructed with an integral rafter segment.

In another preferred embodiment of the invention, each short and long leg is constructed with an integral rafter segment.

BRIEF DESCRIPTION OF THE FIGURES OF THE DRAWING

FIG. 1 depicts the endoskeleton on a single modular end unit attached to a fracking hydro tank in accordance with one embodiment of the invention.

FIG. 2 depicts the partial endoskeleton of a plurality of modular units attached to a plurality of fracking hydro tanks in another embodiment of the invention.

FIG. 3 depicts a complete assembly including tarps overlaying four fracking hydro tanks in accordance with the embodiment of the invention depicted in FIG. 1.

FIG. 4 depicts a typical frac pad installation.

FIG. 5 depicts a typical adjustable leg-foot base assembly.

FIG. 6 depicts an integral partial leg-partial rafter assembly.

DETAILED DESCRIPTION OF THE INVENTION

Figure 4:
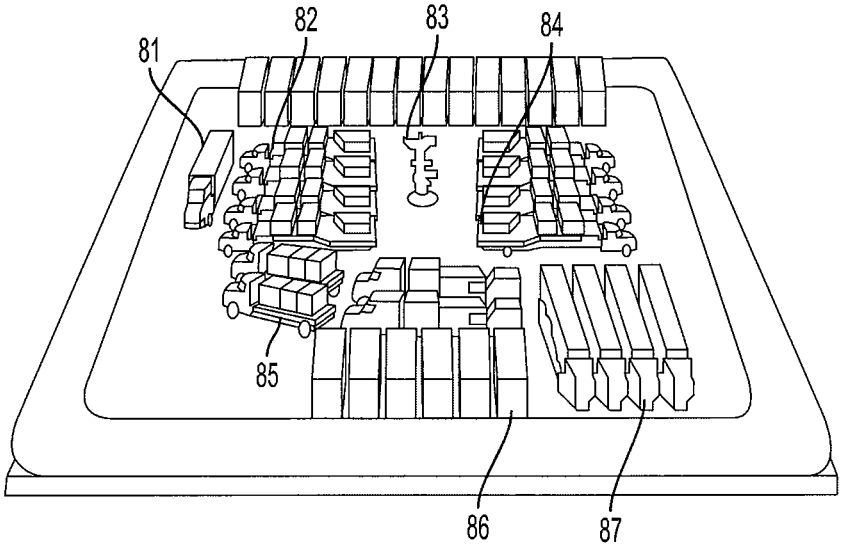

A typical fracking pad consists of a well head, a data monitoring station, frac pumps, a frac blender, chemical storage tanks, sand storage units and a number of hydro tanks. The latter are usually arranged side-by-side, forming a rectangular configuration. A typical frac pad may contain about 4 hydro tanks, although more or less hydro tanks can be present based on the degree of activity of the fracking operation. See FIG. 4 in which 81 represents a data monitoring van, 82 represents the frac pumps, 83 represents the wellhead, 84 represents the frac blender, 85 represents the chemical storage tanks, 86 represents the frac hydro tanks in a series and 87 represents sand storage units. As depicted, the frac hydro tanks are often positioned side-by-side in a rectangular configuration on the frac pad.

Figure 1:
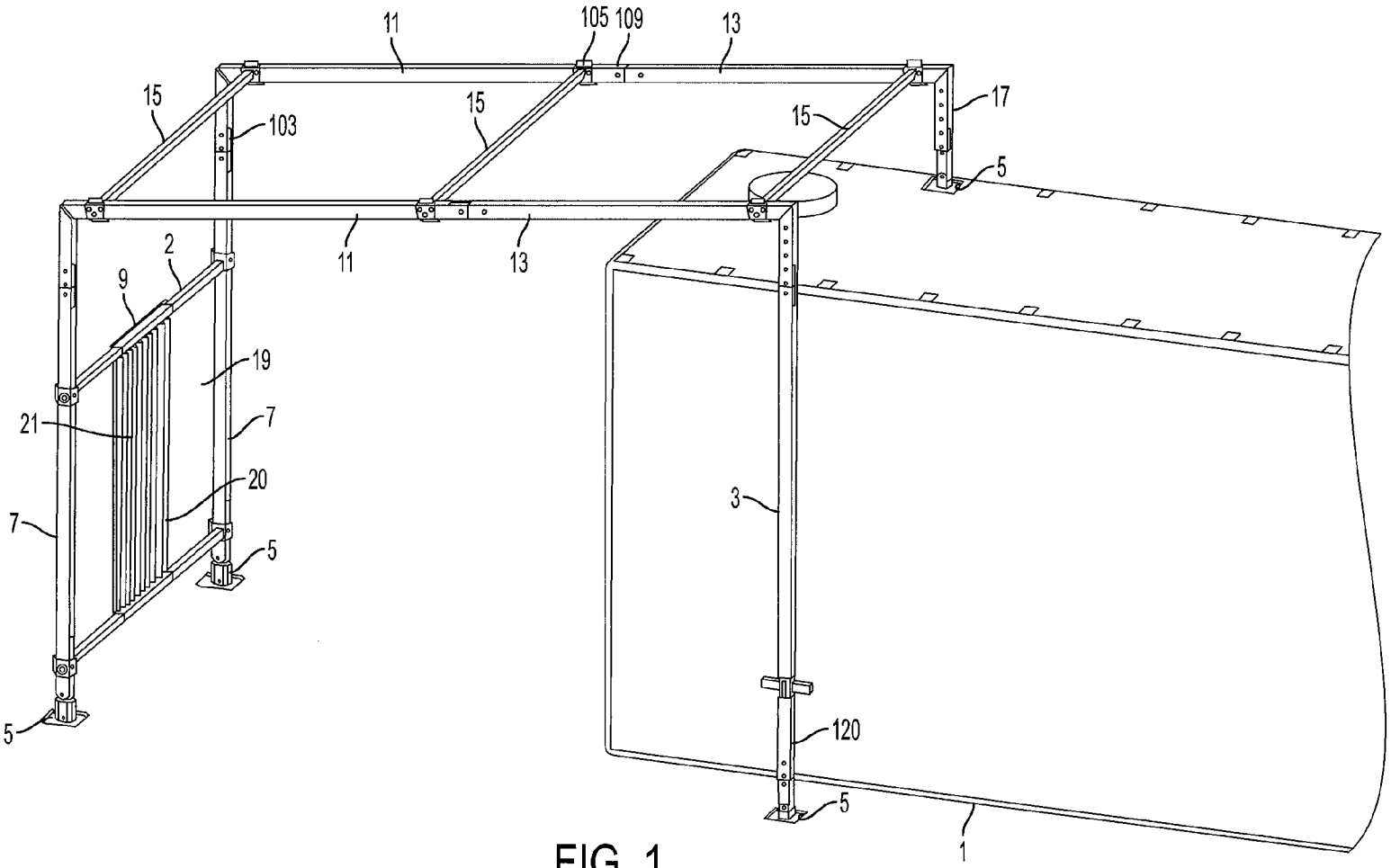
FIGS. 1 through 6 illustrate the present invention, including its two above noted embodiments.
Figure 3:
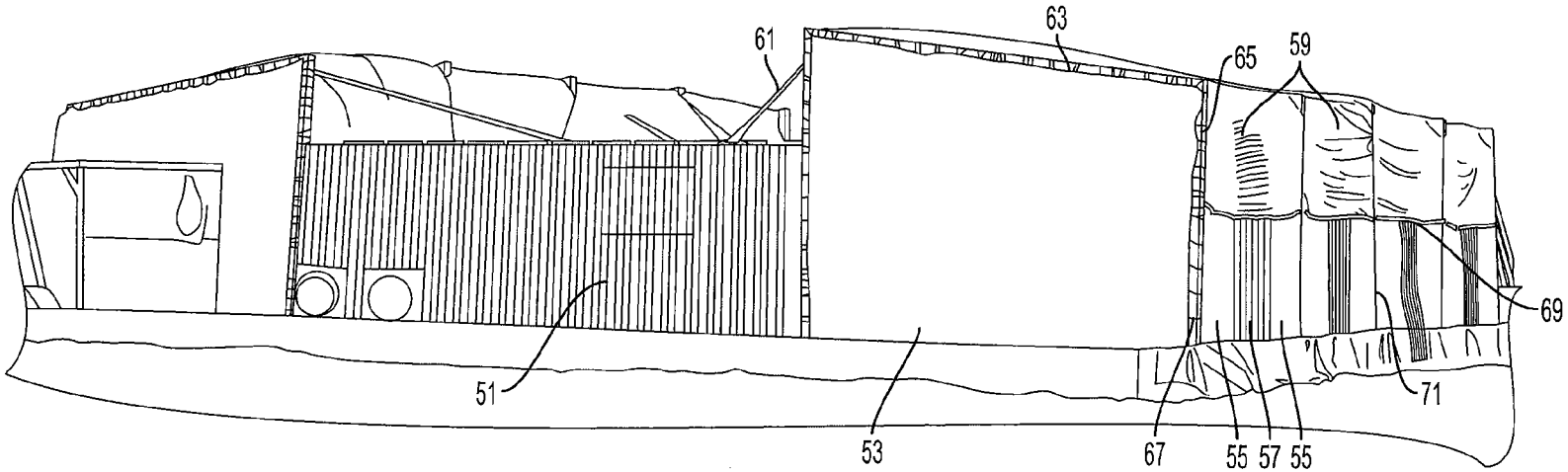

FIG. 1 illustrates the preferred embodiment of the invention in which the end sections and associated liquid conduits (not shown) are to be covered by the protective assembly of the present invention. In this embodiment, the modular endoskeleton covers the end, a portion of an exposed side, and a portion of the top of a single fracking hydro tank 1. The end-type modular unit, as shown in FIG. 3, not only provides support for tarps facing the ends and continuing over a portion of the tops of the hydro tanks, but also provides support for a side tarp so that the entire ends and parts of the tops and parts of the exposed sides of the tanks are encased by a protective envelope formed of individual tarps, one end tarp for each modular endoskeletal unit.

Figure 5:
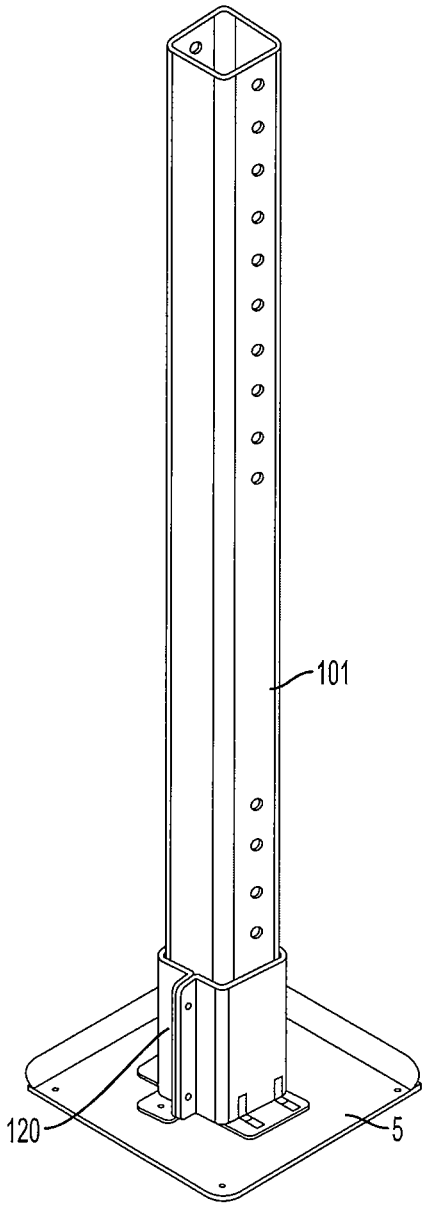

In FIG. 1, the modular end unit comprises four supporting uprights or legs, depicted as elements 7 (two elements 7 supporting the module at its position in front of and also to the side of the hydro tank), and uprights 3 and 17. Each upright is supported at its bottom by a foot 5. Elements 7 are depicted as about the same height as that of the hydro tank. In general, uprights 7 should be about the height dimension or slightly taller than the height dimension of the hydro tank. This height aids in applying the top tarp to the endoskeleton once the endoskeleton is attached to the top of the hydro tank. In FIG. 1, side upright 3 is taller than the height of element 7 and its height equals the height of the hydro tank plus that of short upright 17 which rests on the top of the tank. The four uprights 7 (two), 3 and 17 substantially form a rectangular endoskeleton. Rafters are formed of rafter segments 11 and 13, and in conjunction with cross beams 15 (three shown in FIG. 1) provide the top supporting structure for the modular unit as attached to the top of the tank. These top cross beam elements are attached to the uprights in any conventional manner, such as through use of a slip joint which is pinned during installation. At least upright 3 is adjustable regarding its height so that it can be adjusted to the height of short top leg 17. See FIG. 5 where a typical height adjustable leg is depicted. Leg extension 101 is height adjustable within sleeve 120 of base 5, in which it slides up and down, to be pinned at the desired extended dimension. Further, the use of adjustable legs enables the modular endoskeleton to be used with hydro tanks which are not rectangular shaped, such as wedge shaped hydro tanks.

Figure 6:
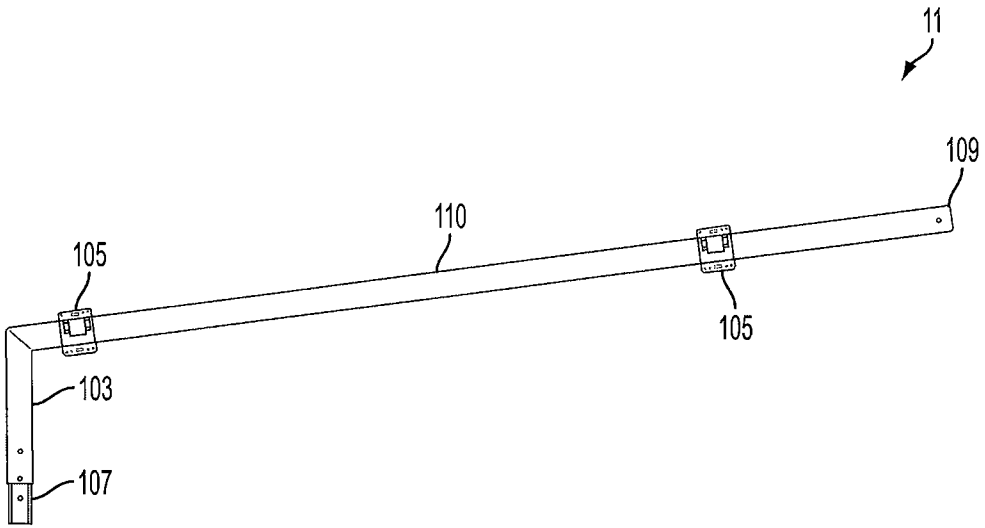

Rafter segments 11 and 13 are integral with their integrated uprights 103 and 17, as depicted in FIGS. 1 and 6. FIG. 6 depicts a typical integrated upright 103-rafter segment 110, in which 105s represents cross beam brackets and 107 is a slip joint for, for example, joining the integrated upright-rafter to leg 7. This integrated element is formed of short upright segment 103 and rafter segment 110. Adjacent rafter segments are joined at 109, such as by use of a slip joint or a bolt and nut attachment.

In a constructed embodiment, the internal angle between short upright 17 and its associated rafter segment is about 82 degrees, while the internal angle between long leg 7 and its associated rafter segment is about 97.5 degrees.

The front of the end modular element of FIG. 1 contains a strip door bracket 9 sitting on a supporting cross bar 2 and positioned at a height to allow access to the area enveloped by the modular unit through weather strip door 21 consisting of a plurality of hanging flexible, heavy gauge plastic strips 20. These strips are attached to bracket 9 and extend to about ground level. Spaces 19 are formed to each side of weather strip door 21, and these spaces will be covered by a rigid sheet material such as OSB board (Oriented Strand Board), as shown in FIG. 3 as element 55.

With a plurality of hydro tanks in side-by-side position there will be a single end modular unit as depicted in FIG. 1 on each outer side of the two end unit tanks, one modular unit being the mirror image of the other. The central modular units of the complete endoskeleton, as connected to each other, will have the same weather strip door 21 and associated uprights 7 and cross bar 2, but will not need long upright 3, since it is not necessary in the middle modular units to protect the sides of the hydro tanks. Instead, the middle modular units, as for example illustrated in FIG. 2, and as understood from FIG. 1, would contain one or more short uprights 17 with associated feet Sand be connected to the front doorway via rafter segments 11 and 13. Preferably, each middle modular unit contains one short upright 17 attached via rafter segments 11 and 13 to a front doorway unit. Then beams 15 are used to attach one modular unit to the next. In this manner, each central module shares an upright or ground leg 7, and rafters 11 and 13, with its adjacent module.

FIG. 3 illustrates the embodiment of the invention in which the modular unit depicted in FIG. 1 is employed. In this instance the ends of a series of four hydro tanks are enveloped within the tarps. End hydro tank unit 51 is partially depicted in FIG. 3, since a portion of the side of the end unit hydro tank 51 (the covered side portion of hydro tank 51 is not shown) is covered by side tarp 53. Elements 65 and 63 correspond to elements 7, and 11 plus 13 of FIG. 1, respectively. Four tarps 59 cover the ends and associated conduits of the four hydro tanks. These tarps extend from about the position of cross bar 2 of FIG. 1 upward over beams 15 to cover the tops of the tanks at the position of short uprights 17, extending from uprights 17 to the tops of the tanks. The tarps are shown tied to the tank tops using cargo straps 61(with a winch) and to the endoskeleton via bungee cords 67 (12 inch ball bungee cords in this instance), the latter cords being attached to all of the uprights and rafters. The tarp is a rip resistant fabric, preferably "rip stop" nylon, described in detail hereinafter. Of course, equivalent tear resistant fabric tarp sheeting (such as vinyl tarps, polyvinylchloride coated fabric and electrostatic coated polyvinylchloride sheeting) can be employed in place of the "rip stop" nylon tarps. The tarps as used contain heavy duty grommets for attachment of the ties. Rigid boards 55, such as OSB board, surround entrance way 57. Insulation materials 69 and 71 form air resistant barriers between the doorway units and the tarps, and between adjacent OSB boards. Additional small tarps can be used in addition to those shown when needed to fill in gaps.

Figure 2:
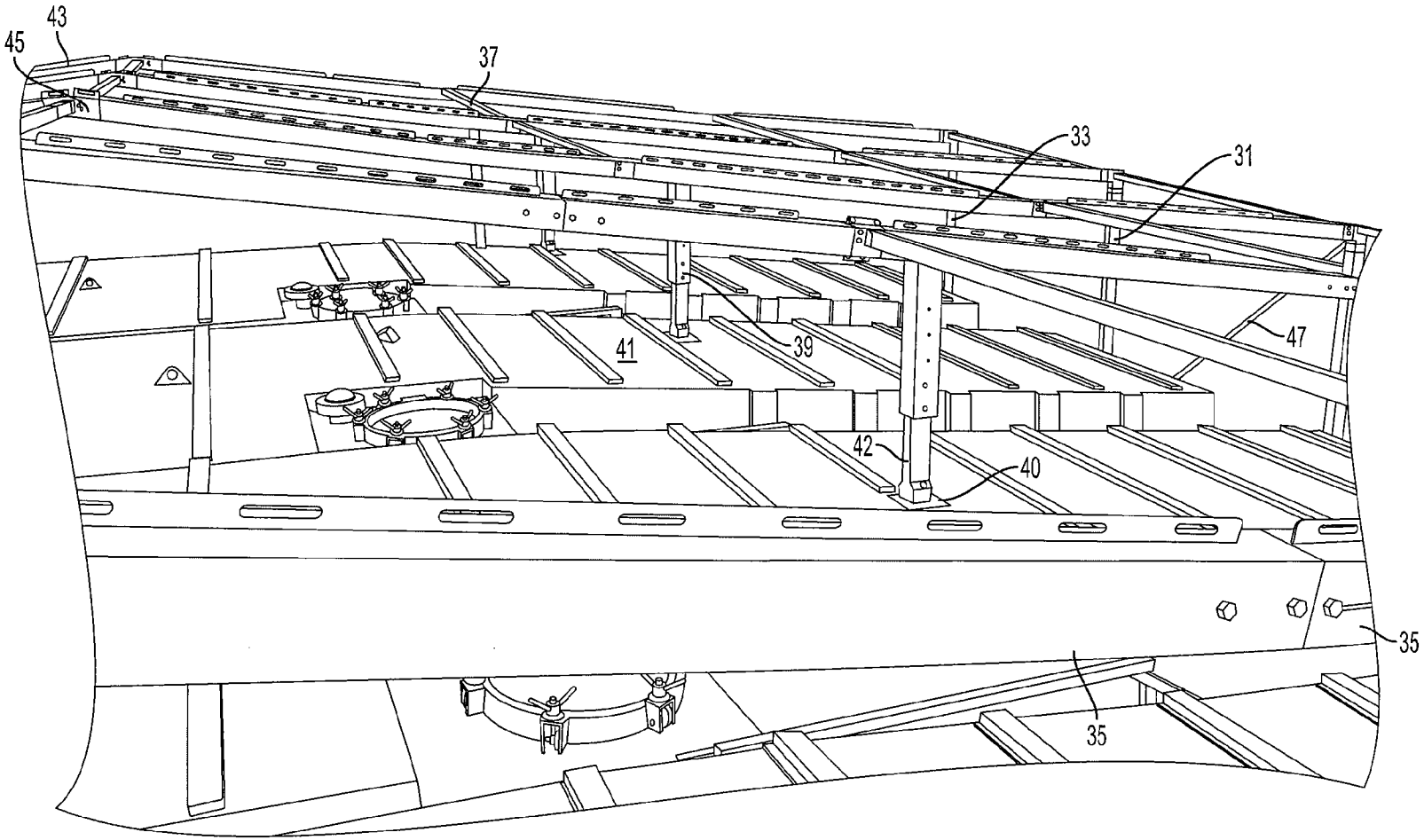

FIG. 2 depicts the endoskeleton modular structure for a second embodiment of the present invention in which the endoskeleton will extend from beyond one end of the hydro tanks, completely over the entire tops of the tanks 41 to the other end of the tanks and somewhat beyond so as to encompass not only the entire sides, ends and tops of the hydro tanks, but also piping and other fluid devices positioned near the sides and ends of the tanks. In FIG. 2, each middle modular unit contains a long upright or leg 31 and a short upright or leg 39 supported by a foot 40 and connector 42. An end modular unit upright or leg is element 33, corresponding to element 3 of FIG. 1. In this embodiment, rafters 35 extend beyond short legs 39 to the apex area, meeting A-frame expansion bracket 45, which is approximately above the center of the longitudinal distance of the tank tops. Then the endoskeletal structure as depicted in FIG. 2 extends downwardly via rafters 43 to the opposite ends of the tanks. Rafters 43 are part of the modular units that would be in position along the opposite ends of the hydro tanks. These oppositely positioned modular units are identical to those depicted in FIG. 2, including short uprights 39, one for each tank top as depicted in FIG. 2. Again, if desired, a second upright 39 with foot 40 and connector 42 could be used as supported by a second set of rafters 35 or positioned along cross beam 37.

As discussed and shown by the Drawing, in preferred embodiments of the present invention, the legs or uprights are integral with rafter segments. This aids the erection and dismantle of the modular units. Additional centrally positioned rafter segments can join the end integral rafter segments through the use of slip joints.

In the depicted embodiments, the components of the endoskeletons are constructed of light weight aluminum. Other materials could be employed for construction of the endoskeleton components such as a light weight steel or a rigid plastic. These components are engineered to contain apertures, usually about every 12 inches, through which the tarps are secured.

The completed covered units of the invention provide a wind break and a heat canopy. Further, fast installation, no maintenance and quick tear down are also provided.

In practice, at least one heater is positioned within the enclosed hydro tanks, or outside with suitable feed duct work reaching inside the enclosed hydro tanks, to provide heat inside the enclosure. During extremely cold outside temperatures, this heat is trapped by the heat tent of the present invention and is sufficient to prevent freezing of fluid conduits positioned within the canopy. A typical heater in use on frac pads is rated at 500,000 BTU and blows heated air of about 144 degrees F.

The OSB boards depicted in the Drawing can be replaced by other rigid sheet materials constructed of metal or plastic. Further, the OSB boards can be eliminated partly or entirely and replaced by additional weather strip doors.

In practice to date, "ripstop" nylon tarps available from The Flag Lady's Flag Store of Columbus, Ohio, are used to prepare the tarps used to enclose the endoskeleton modules described herein. These "ripstop" nylon tarps are available for purchase in approximately 60 inch wide widths and in various lengths. For most locations for covering the endoskeleton, two or more of these tarps will need to be bound side-to-side and/or bottom-to-top to provide a size sufficient for use, that is, sizes sufficient to be tied to uprights, rafters and cross beams of the endoskeleton. This "ripstop" nylon is 70 denier, 1.9 oz. and dyed black with a durable water repellent polyurethane finish and is ultraviolet treated. Construction is 115 wrap, 87 fill. Edges of tarps to be joined are covered with canvas fabric by rolling the canvas with two layes of the nylon fabric and in which brass grommets are placed, 12 inches apart from one another. The tarps are bound together using 4 inch bungee cords. The assembled tarps are secured to the endoskeleton using 12 inch bungee cords or cargo straps, every 12 inches. The tarps across the rafters and the tarp sections extending downward to about the top of the weather doors can be perforated to provide wind vents, which are 5 inch long staggered cuts in a curve configuration. For example, for about a 10 foot wide finished tarp, a plurality of wind vents can be started about 4 inches off the center on both sides with one additional row on each side centered between the center row of wind vents and the side edge. The four rows of wind vents can be started about 6 feet in from the top of the tarp and can extend to about 6 feet from the bottom tarp edge. The wind vents are about 5 inches long and about 5 inches apart from one another in a row.

A typical short leg extends to a height of about 4 feet above the top of a hydro tank.

Variations of the invention will be apparent to the skilled artisan.

What is claimed is:

1. A frac pad containing a plurality of fracking hydro tanks positioned side-by-side in a rectangular configuration on said pad, and a temporary modular endoskeleton enclosed by rip resistant fabric sheets and positioned so that at least the ends of each tank, at least a portion of exposed sides of said hydro tanks and at least a portion of the top of each hydro tank are enclosed by the fabric sheets, and wherein the modular endoskeleton comprises a module comprising at least one rafter spaced apart from and continuously extending from a first location above the top of a hydro tank to a second location in front of and spaced apart from an end of the hydro tank, a first short leg positioned on said hydro tank and extending vertically from the top of the hydro tank and connected to the rafter at said first location and a first long leg extending vertically from the ground to connect to the rafter at said second location.

2. The frac pad of claim 1 wherein said module additionally comprises a second rafter co-extensive with said at least one rafter and spaced apart from a side of an end unit hydro tank, a second long leg extending vertically from the ground and connected to the second rafter at a location to the side of the hydro tank across from the first short leg and at a height substantially equal to the height of the tank and the height of the first short leg and a third long leg positioned to the side of the tank and directly across from and at substantially the same distance from a tank end as the first long leg and extending vertically from the ground and connected to an end of said second rafter.

3. The frac pad of claim 2 wherein the first short leg and the first, second and third long legs substantially form a rectangle.

4. The frac pad of claim 3 wherein each of said legs is approximately perpendicular to the ground.

5. The frac pad of claim 4 wherein a module of claim 4 is positioned at each of the two opposite exposed sides of end hydro tank units.

6. The frac pad of claim 1 wherein a module of claim 1 is positioned at the end of each centrally positioned hydro tank.

7. The frac pad of claim 4 wherein said first short leg rises about at least four feet above the top of the hydro tank.

8. The frac pad of claim 4 wherein the internal angle between said first short leg and said first rafter is about 82 degrees.

9. The frac pad of claim 4 wherein the internal angle between said first long leg and said first rafter is about 97.5 degrees.

10. The frac pad of claim 4 comprising a plurality of cross beams connecting adjacent pairs of rafters.

11. The frac pad of claim 4 comprising a cross beam connecting adjacent first and third or pairs of first long legs.

12. The frac pad of claim 11 comprising two rigid sheets extending downwardly from said cross beam and forming an entrance way there between.

13. The frac pad of claim 4 comprising pairs of modules, one module of each pair being positioned at each end of each hydro tank, said module pairs being connected to each other by means of rafters extending across the roof of each hydro tank.

14. The frac pad of claim 13 wherein said rafters are formed of a plurality of shorter rafter segments connected to one another end to end.

15. The frac pad of claim 13 wherein adjacent rafters are connected to each other by at least one cross beam.

16. The frac pad of claim 2 wherein each rafter is formed of at least two rafter segments.

17. The frac pad of claim 16 wherein an upper segment of each short leg and of each first long leg is integral with its adjoining rafter segment.

18. The frac pad of claim 16 wherein an upper segment of each second and of each third long leg is integral with its adjoining rafter segment.

19. The frac pad of claim 12 wherein a plurality of vertically positioned rigid plastic strips form said entrance way.

20. The frac pad of claim 2 wherein at least one of said short and long legs comprises a lower extendible leg segment attached at its bottom to a sleeve attached to a base plate.

21. The frac pad of claim 4 wherein each module is secured to its associated hydro tank by means of cord or cable so that the weight of the hydro tank anchors the module.

22. The frac pad of claim 21 wherein individual fabric sheets are attached to the endoskeleton by means of cord or cable.

* * * * *